US006303563B1

(12) United States Patent
De Buzzaccarini et al.

(10) Patent No.: US 6,303,563 B1
(45) Date of Patent: Oct. 16, 2001

(54) LIQUID DETERGENT AND FOAM COMPOSITIONS COMPRISING A DIESTER OR DIAMIDE QUATERNARY AMMONIUM COMPOUND

(75) Inventors: Francesco De Buzzaccarini, Breendonk; Thomas Wilhelm Hoerner, Overijse, both of (BE); Bertrand Guichard, Paris (FR)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/622,377

(22) PCT Filed: Feb. 10, 1999

(86) PCT No.: PCT/IB99/00229

§ 371 Date: Aug. 16, 2000

§ 102(e) Date: Aug. 16, 2000

(87) PCT Pub. No.: WO99/42550

PCT Pub. Date: Aug. 26, 1999

(30) Foreign Application Priority Data

Feb. 19, 1998 (EP) ..... 98200531

(51) Int. Cl.[7] ..... C11D 1/62; C11D 3/386; C11D 9/16

(52) U.S. Cl. ..... 510/504; 510/276; 510/287; 510/300; 510/320; 510/329; 510/330; 510/338; 510/339; 510/345; 510/407; 510/420; 510/460; 510/530

(58) Field of Search ..... 510/276, 287, 510/300, 320, 329, 330, 338, 339, 345, 407, 420, 460, 504, 530

(56) References Cited

U.S. PATENT DOCUMENTS 5,721,202 * 2/1998 Waite et al. ..... 510/102

FOREIGN PATENT DOCUMENTS

| | | | |
|---|---|---|---|
| 0 753 556 A1 | 1/1997 | (EP) | C09K/3/30 |
| 0 765 932 A1 | 4/1997 | (EP) | C11D/3/12 |
| 2 303 147 A | 5/1996 | (GB) | C11D/3/386 |
| WO 97/43381 | 11/1997 | (WO) | C11D/3/386 |

* cited by examiner

*Primary Examiner*—Mark Kopec
*Assistant Examiner*—Charles Boyer
(74) *Attorney, Agent, or Firm*—C. Brant Cook; Kim William Zerby; Steven W. Miller

(57) ABSTRACT

The present invention relates to a liquid detergent composition comprising enzymes and a boron derived enzyme stabilising agent which can be used as a cleaning and softening composition in domestic laundry processes and which further comprises diester or diamide quaternary ammonium compound, preferably a diester quaternary ammonium compound. Preferably the composition has a pH which is between 7 and 10, more preferably between 7.5 and 8.5 when diluted to a 1% solution in distilled water. Whilst the composition may be used directly in the form of a liquid, or may be predissolved in water, in a preferred execution of the present invention the composition is used in the form of a foam or a gel or paste.

15 Claims, No Drawings

LIQUID DETERGENT AND FOAM COMPOSITIONS COMPRISING A DIESTER OR DIAMIDE QUATERNARY AMMONIUM COMPOUND

RELATED APPLICATIONS

This application is a §371 application of PCT/IB99/00299 filed Feb. 10, 1999, which claims priority under §119 to European Patent Application No. 98200531.6 filed Feb. 19, 1998.

The present invention relates to liquid detergent and foam compositions, such as those used for washing and treating clothes.

Liquid laundry detergents comprising a surfactant system and enzymes have been sold commercially since the early 1980's. Up to now most of these liquid laundry detergents have included a substantial amount of anionic surfactant in the surfactant system. Cationic surfactants are usually not used in liquid laundry detergents because they complex with the anionic surfactants, and the surfactant system becomes less effective. Furthermore cationic surfactants which are selected because they are more biodegradable are generally considered to be unsuitable for use in liquid laundry detergents because the biodegradable cationic surfactants are somewhat hydrolytically unstable at the slightly alkaline pH of conventional liquid laundry detergents In the technical field of rinse added fabric softeners there are some disclosures of quaternary esters in compositions which also comprise certain enzymes. Conventional rinse added fabric softeners are essentially free of anionic surfactants, and so the complexation problem does not arise. WO9113136, published on Sep. 5, 1991 discloses combinations of cationic surfactants with enzymes at pH7. WO9505442, published on Feb. 23, 1995 and WO9529980, published on Nov. 9, 1995 disclose combinations of ester quats with cellulase at pH of 2 to 4.5 (e.g. the '442 application at page 6, line 1) including various chelants to stabilise the enzyme.

However these rinse added fabric softeners are usually formulated at acidic pH.

The object of the present invention is to provide a liquid detergent composition comprising enzymes and a boron derived enzyme stabilising agent which can be used as a cleaning and softening composition in domestic laundry processes. The liquid detergent can have a wide range of viscosity, and can also be in the form of a gel or paste.

SUMMARY OF THE INVENTION

The object of the invention is achieved by a composition which further comprises diester or diamide quaternary ammonium compound, preferably a diester quaternary ammonium compound. Preferably the composition has a pH which is between 7 and 10, more preferably between 7.5 and 8.5 when diluted to a 1% solution in distilled water.

Whilst the composition may be used directly in the form of a liquid, or may be predissolved in water, in a preferred execution of the present invention the composition is used in the form of a foam.

It is preferred that the liquid detergent composition or the foam composition comprises less than 25% by weight of water, more preferably less than 15% by weight of water, optionally with other solvents, such as organic solvents.

DETAILED DESCRIPTION OF THE INVENTION (1) Preferred quaternary ammonium compound have the formula $$\left[(R)_{4-m}\overset{+}{N}\text{-}[(CH_2)_n\text{-}Q\text{-}R^1]_m\right]\ X^- \tag{1}$$

or the formula:

$$\left[(R)_{4-m}\overset{+}{N}\text{-}[(CH_2)_n\text{-}\underset{\underset{Q\text{-}R^1}{|}}{CH}\text{-}CH_2\text{-}Q\text{-}R^1]_m\right]\ X^- \tag{2}$$

wherein Q is a functional unit having the formula:

$$\text{-}O\text{-}\overset{\overset{O}{\|}}{C}\text{-},\quad \text{-}\overset{\overset{O}{\|}}{C}\text{-}O\text{-},\quad \text{-}O\text{-}\overset{\overset{O}{\|}}{C}\text{-}O\text{-},$$

each R unit is independently hydrogen, $C_1$–$C_6$ alkyl, $C_1$–$C_6$ hydroxyalkyl, and mixtures thereof, preferably methyl or hydroxy alkyl; each $R^1$ unit is independently linear or branched $C_{11}$–$C_{22}$ alkyl, linear or branched $C_{11}$–$C_{22}$ alkenyl, and mixtures thereof, $R^2$ is hydrogen, $C_1$–$C_4$ alkyl, $C_1$–$C_4$ hydroxyalkyl, and mixtures thereof; X is an anion which is compatible with compounds and adjunct ingredients; the index m is from 1 to 4, preferably 2; the index n is from 1 to 4, preferably 2.

An example of a preferred compound is a mixture of quaternized amines having the formula:

$$R_2\text{-}\overset{+}{N}\text{-}[(CH_2)_n\text{-}O\text{-}\overset{\overset{O}{\|}}{C}\text{-}R^1]_2\ X^-$$

wherein $R_2$ is preferably methyl; $R^1$ is a linear or branched alkyl or alkenyl chain comprising at least 11 atoms, preferably at least 15 atoms. In the above fabric softener example, the unit $-R^1$ represents a fatty alkyl or alkenyl unit which is typically derived from a triglyceride source. The triglyceride source is preferably derived from tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures of these oils.

The preferred compound of the present invention are the Diester and/or Diamide Quaternary Ammonium (DEQA) compounds, the diesters and diamides having the formula:

$$\left[(R)_{4-m}\overset{+}{N}\text{-}[(CH_2)_n\text{-}Q\text{-}R^1]_m\right]\ X^-$$

wherein R, $R^1$, X, and n are the same as defined herein above for formulas (1) and (2), and Q has the formula:

$$\text{-}O\text{-}\overset{\overset{O}{\|}}{C}\text{-}\quad \text{or}\quad \text{-}\overset{\overset{H}{|}}{N}\text{-}\overset{\overset{O}{\|}}{C}\text{-}.$$

These preferred compounds are formed from the reaction of an amine with a fatty acyl unit to form an amine intermediate having the formula:

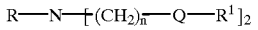

wherein R is preferably methyl, Q and $R^1$ are as defined herein before; followed by quaternization to the final softener active.

Non-limiting examples of preferred amines which are used to form the DEQA compounds according to the present invention include methyl bis(2-hydroxyethyl)amine having the formula:

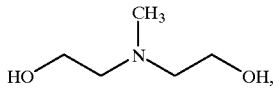

methyl bis(2-hydroxypropyl)amine having the formula:

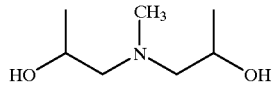

methyl (3-aminopropyl) (2-hydroxyethyl)amine having the formula:

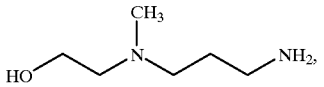

methyl bis(2-aminoethyl)amine having the formula:

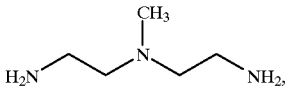

triethanol amine having the formula:

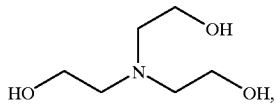

di(2-aminoethyl) ethanolamine having the formula:

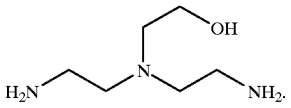

The counterion, $X^{(-)}$ above, can be any softener-compatible anion, preferably the anion of a strong acid, for example, chloride, bromide, methylsulfate, ethylsulfate, sulfate, nitrate and the like, more preferably chloride or methyl sulfate. The anion can also, but less preferably, carry a double charge in which case $X^{(-)}$ represents half a group.

Tallow and canola oil are convenient and inexpensive sources of fatty acyl units which are suitable for use in the present invention as $R^1$ units. The following are non-limiting examples of quaternary ammonium compounds suitable for use in the compositions of the present invention. The term "tallowyl" as used herein below indicates the $R^1$ unit is derived from a tallow triglyceride source and is a mixture of fatty alkyl or alkenyl units. Likewise, the use of the term canolyl refers to a mixture of fatty alkyl or alkenyl units derived from canola oil.

Fabric Softener Actives

N,N-di(tallowyl-oxy-2-oxo-ethyl)-N-methyl, N-(2-hydroxyethyl) ammonium chloride;

N,N-di(canolyl-oxy-2-oxo-ethyl)-N-methyl, N-(2-hydroxyethyl) ammonium chloride;

N,N-di(tallowyloxy-2-oxo-ethyl)-N,N-dimethyl ammonium chloride;

N,N-di(canolyloxy-2-oxo-ethyl)-N,N-dimethyl ammonium chloride

N,N,N-tri(tallowyl-oxy-2-oxo-ethyl)-N-methyl ammonium chloride;

N,N,N-tri(canolyl-oxy-2-oxo-ethyl)-N-methyl ammonium chloride;

N-(tallowyloxy-2-oxo-ethyl)-N-(tallowyl)-N,N-dimethyl ammonium chloride;

N-(canolyloxy-2-oxo-ethyl)-N-(canolyl)-N,N-dimethyl ammonium chloride; 1.2-di(tallowyloxy-oxo)-3-N,N,N-trimethylammoniopropane chloride; and 1,2-di(canolyloxy-oxo)-3-N,N,N-trimethylammoniopropane chloride;

N-(canoyloxy-2-oxo-ethyl), N-methyl, N,N-di(2-hydroxyethyl) ammonium chloride

N-(tallowyloxy-2-oxo-ethyl), N-methyl, N,N-di(2-hydroxyethyl) ammonium chloride and mixtures of the above actives.

Other examples of quaternary ammonium compounds are methylbis(tallowamido-ethyl)(2-hydroxyethyl)ammonium methylsulfate and methylbis(hydrogenated tallowamidoethyl)(2-hydroxyethyl)ammonium methylsulfate; these materials are available from Witco Chemical Company under the trade names Varisoft® 222 and Varisoft®110, respectively.

Particularly preferred is N,N-di(canolyl-oxy-2-oxo-ethyl)-N-methyl, N-(2-hydroxyethyl) ammonium chloride.

The level of unsaturation contained within the tallow, canola, or other fatty acyl unit chain can be measured by the Iodine Value (IV) of the corresponding fatty acid, which in the present case should preferably be in the range of from 5 to 100 with two categories of compounds being distinguished, having a IV below or above 25.

Indeed, for compounds having the formula:

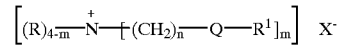

derived from tallow fatty acids, when the Iodine Value is from 5 to 25, preferably 15 to 20, it has been found that a cis/trans isomer weight ratio greater than about 30/70, preferably greater than about 50/50 and more preferably greater than about 70/30 provides optimal concentration formulations.

For compounds of this type made from tallow fatty acids having a Iodine Value of above 25, the ratio of cis to trans isomers has been found to be less critical unless very high concentrations are needed.

Other suitable examples of compounds are derived from fatty acyl groups wherein the terms "tallowyl" and canolyl" in the above examples are replaced by the terms "cocoyl, palmyl, lauryl, oleyl, ricinoleyl, stearyl, palmityl," which correspond to the triglyceride source from which the fatty acyl units are derived. These alternative fatty acyl sources can comprise either fully saturated, or preferably at least partly unsaturated chains.

As described herein before, R units are preferably methyl, however, suitable compounds are described by replacing the term "methyl" in the above examples in Table 11 with the units "ethyl, ethoxy, propyl, propoxy, isopropyl, butyl, isobutyl and t-butyl.

The counter ion, X, in the examples of Table II can be suitably replaced by bromide, methylsulfate, formate, sulfate, nitrate, and mixtures thereof. In fact, the anion, X, is merely present as a counterion of the positively charged quaternary ammonium compounds. The scope of this invention is not considered limited to any particular anion.

As used herein, when the diester is specified, it will include the monoester that is normally present in manufacture. The overall ratios of diester to monoester are from about 100:1 to about 2:1, preferably from about 50:1 to about 5:1, more preferably from about 13:1 to about 8:1. The level of monoester present can be controlled in the manufacturing of the compound.

Mixtures of actives of formula (1) and (2) may also be prepared.

Cationic surfactants are used in the compositions of the present invention preferably at levels of at least 3% by weight, more preferably from 5% to 50% by weight, and most preferably at levels of from 8% to 20% by weight.

Water-soluble nonionic surfactants are also useful as surfactants in the compositions of the invention. Indeed, preferred processes use cationic/nonionic blends. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with from 1 to 25 moles of ethylene oxide per mole of alcohol, especially 2 to 7 moles of ethylene oxide per mole of alcohol. Particularly preferred are the condensation products of alcohols having an alkyl group containing from about 9 to 15 carbon atoms; and condensation products of propylene glycol with ethylene oxide.

Other preferred nonionics are polyhydroxy fatty acid amides which may be prepared by reacting a fatty acid ester and an N-alkyl polyhydroxy amine. The preferred amine for use in the present invention is N-(R1)-CH2(CH20H)4-CH2-OH and the preferred ester is a C12–C20 fatty acid methyl ester. Most preferred is the reaction product of N-methyl glucamine (which may be derived from glucose) with C12–C20 fatty acid methyl ester.

Methods of manufacturing polyhydroxy fatty acid amides have been described in WO 9206073, published on Apr. 16, 1992. This application describes the preparation of polyhydroxy fatty acid amides in the presence of solvents. In a highly preferred embodiment of the invention N-methyl glucamine is reacted with a C12–C20 methyl ester.

Other surfactants that may be used in the compositions of the present invention include C10–C18 glycerol ethers, C10–C18 alkyl polyglycoside and their corresponding sulphated polyglycosides, alkyl ester sulphonates, and oleoyl sarcosinate.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms. Non ionic surfactants are preferably used in the compositions of the present invention at levels of from 0% to 50% by weight, and preferably from 20% to 30% by weight.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

Anionic surfactants may also be used, but preferably in minor amounts. It is preferred that the compositions comprise less than 3% by weight of anionic surfactant, and even more preferably that the compositions are substantially free of anionic surfactant.

The compositions of the present invention can contain neutral or alkaline salts which have a pH in solution of seven or greater, and can be either organic or inorganic in nature. The builder salt assists in providing the desired density and bulk to the detergent granules herein. While some of the salts are inert, many of them also function as detergency builder materials in the laundering solution.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4.

Examples of neutral water-soluble salts include the alkali metal, ethanolamine, ammonium or substituted ammonium chlorides, fluorides and sulfates. The sodium, ethanolamine and ammonium salts of the above are preferred. Citric acid and, in general, any other organic or inorganic acid may be incorporated into the present invention.

Other useful water-soluble salts include the compounds commonly known as detergent builder materials. Builders are generally selected from the various water-soluble, alkali metal, ethanolamine, ammonium or substituted ammonium phosphates, polyphosphates, phosphonates, polyphosphonates, carbonates, silicates, borates, and polyhyroxysulfonates. Preferred are the sodium, ethanolamine and ammonium salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the salts of ethylene diphosphonic acid, the salts of ethane 1-hydroxy-1,1-diphosphonic acid and the salts of ethane, 1,1,2-triphosphonic acid. Other phosphorous builder compounds are disclosed in U.S. Pat. Nos. 3,159,581; 3,213,030; 3,422,021; 3,422,137; 3,400,176 and 3,400,148, incorporated herein by reference. In general, however, phosphates are preferably avoided for environmental reasons.

Enzymes are included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published January 9, 1985).

Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as Pseudomonas stutzeri ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex Pseudomonas gladioli. The LIPOLASE enzyme derived from Humicola lanuginosa and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Boron derived enzyme stabilising agents are preferably selected from the group consisting of borax or boric acid or one of its salts, or mixtures thereof. Preferred salts are the alkali metal or alkanolamine salts of tetraborate or metaborate. Most preferred are sodium metaborate, monoethanalomine borate, boric acid and borax.

It is important to distinguish between the foam of the present invention and the suds which are commonly encountered in everyday washing process. The foam of the present invention is much more concentrated and comprises less water than conventional suds. Foam comprises less than 90%, preferably less than 75%, more preferably less than 50%, even more preferably less than 30%, and most preferably less than 15% by weight of water. The foam of the present invention comprises at least 18% by weight, and preferably at least 25% by weight of a surface active agent. Most preferred foams for use as cleaning compositions comprise at least 10% by weight, preferably at least 20% by weight of anionic surfactant.

On the other hand, suds, which are formed in conventional washing process when detergents are diluted prior to washing, are formed from quite dilute solutions typically 100 g of product in 10 litres of water. The result is a wash liquor which comprises about 99% by weight of water. A layer of suds may form on the surface of the wash liquor, the composition of the suds being similar to that of the wash liquor itself. The surfactant content of the suds will normally be much less than 1%, typically less than 0.3%.

Consequently the difference between the foam of the present invention and the suds of a conventional washing process will be understood.

In a preferred aspect of the present invention the composition is delivered in the form of a highly concentrated foam comprising less than 25% by weight of water, preferably less than 15% by weight of water.

It will also be recognised by the man skilled in the art that suds are often considered undesirable in the washing process and antisuds agents are often employed to reduce or control them. In a washing process in which the solution of detergent active agents is the medium of transport of the actives to the fiber surface, the presence of suds can diminish washing performance. This is because the detergent actives which are in the suds are no longer dissolved in the washing liquor itself, and are not therefore efficiently transported to the fiber surface.

The packaged product of the present invention comprises a sealed container, such as an essentially cylindrical bottle, having a dispensing means such as a nozzle. The container contains the composition and propellant. Suitable containers may be made from any material, especially aluminum, tin-plate, plastics including PET, OPP, PE or polyamide and including mixtures, laminates or other combinations of these. Foam is dispensed when the nozzle is activated and the detergent is released together with the propellant gas. The propellant gas expands to form many "bubbles" within the composition thereby creating the foam. Preferred propellants are hydrofluorocarbons, chlorofluorocarbons, alkanes including propane and butane, carbon dioxide, nitrous oxide, nitrogen, air or mixtures thereof. Most preferred are carbon dioxide and nitrous oxide. Various ways to pressurise the propellant gas are known in the art. For example the gas may be pressurised at the time of packing. The product may be physically separated from a compressed gas by a membrane such as rubber under tension. Alternatively a means for pressurising the gas subsequently by mechanical action may be provided (so-called "pump and spray" systems).

Various apparatus for delivering foams are described in U.S. Pat. No. 5,364,031 issued on Nov. 15, 1994 entitled "Foam Dispensing Nozzles and Dispensers Employing Said Nozzles".

Any nozzle or nozzle/valve assembly which provides a means for releasing the mixture of detergent ingredients from the container and provides a foam is suitable for use in the present invention. The Precision Valve Company (Valve Precision in France) supplies a range of nozzle assemblies for various applications including shaving foams and carpet cleaners under various trade names including City®, Montego®, Power Jet®, Vulcan® and Visco®. Nozzles which disperse the foam both horizontally and vertically (when the container is held upright) are available. Metering nozzles which dispense a predetermined amount of foam are also available and useful in the present invention. Metering valves are disclosed in WO9108965 (Precision Valve Co) and EP-A 616953 (3 M Co). In order for the apparatus to be effective in the method of the present invention it should deliver the foam at a rate of at least 3 g per second of foam from the sealed container, more preferably at a rate of at least 10 g per second.

Methods of Cleaning

Handwash

The method of the present invention may be used to wash textile fabrics by hand (referred to herein as "handwash"). According to one embodiment of the invention the liquid detergent composition is dissolved in water to form an aqueous washing solution, and the textile fabrics are then treated in the washing solution. In an alternative embodiment of the invention the foam is dispensed onto or around the textile fabrics to be washed, and then the foam is thoroughly distributed over the textile fabrics, if necessary, by agitating the textile fabrics and foam by hand. It is believed that the high surface area of the foam enables the active ingredients to be well-distributed over the surface of the textile fabrics. Furthermore it is believed that the intimate proximity of the active, non-diluted foam to the textile fabrics promotes excellent cleaning.

The textile fabrics may be left to soak in the washing solution, or in the foam for anything up to several days, or even weeks. However it is preferred that the soaking time is between 1 minute and 24 hours, preferably between 5 minutes and 4 hours.

If desired any foam residue may subsequently be removed from the textile fabrics. For example the residue may be rinsed out using clean water or it may be removed from the textile fabrics by applying a vacuum.

A typical handwash composition will comprise some or all of the following components: surfactants (anionic, nonionic, cationic, amphoteric, zwitterionic), detergent builders and chelating agents, soil release polymers, optical brightener, dye transfer inhibition polymer, perfume, enzymes, colorants, antifoam agents.

Surfactants are preferably present at a level of from 18% to 90% by weight of the composition, preferably 20% to 80% of the composition, more preferably from 25% to 50% of the composition and most preferably about 30% by weight of the composition.

Detergent builders such as fatty acids, citric acid, succinic acid, phosphate, zeolite are preferably present at a level of from 10% to 90% by weight of the composition, preferably 10% to 50% of the composition, more preferably from 12% to 20% by weight of the composition.

Chelating agent such as phosphonate are preferably present at a level of from 0% to 5%, more preferably from 0.1% to 3% by weight of the composition.

Machine Wash

The method of the present invention may be used to wash textile fabrics in a conventional washing machine or, alternatively, if no added water is required, in a conventional drying machine (both cases referred to herein as "machine wash"). The liquid detergent or foam composition of the present invention is simply dispensed into the drum of the machine either before or after the soiled textile fabrics have been loaded.

The wash cycle may be completed by any combination of washing, rinsing, conditioning and/or drying steps, during any one of which additional wash or rinse additives may be introduced into the machine drum.

The compositions suitable for machine wash foams are similar to those described above for handwash foams.

EXAMPLES

| Foaming Detergent | Ex 1 | Ex. 2 | Ex. 3 | Ex.4 | Ex. 5 |
|---|---|---|---|---|---|
| Composition: | | | | | |
| Alkyl benzenesulfonate | — | — | 1.0 | — | — |
| Alkyl sulfate | — | — | — | — | — |
| Alkyl ether sulfate | — | — | — | — | — |
| Nonionic E07 | 30 | 20 | 29 | 30 | 25 |
| C12–18 glucose amide | — | 10 | — | — | — |
| Cationic surfactant A | 15 | 10 | 15 | — | 15 |
| Cationic surfactant B | — | | — | 10 | — |
| Ethanol | 2.5 | 2.5 | 2.5 | 2.5 | 2.5 |
| PEG 200 | 8.8 | 8.8 | 8.8 | 8.8 | 30 |
| Propylene glycol | 20 | 20 | 20 | 20 | 10 |
| Hexylene glycol | 1.3 | 0.9 | 1.3 | 0.9 | 1.3 |
| Monoethanolamine | 2.3 | 2.3 | 2.3 | 2.3 | 2.3 |
| Citric Acid | 2.5 | 2.5 | 2.5 | 2.5 | — |
| Fatty acid | — | — | — | — | — |
| Boric acid | 2.0 | 2.0 | 2.0 | 2.0 | 2.0 |
| Enzymes | 0.5 | 0.5 | 0.5 | 0.5 | 0.6 |
| Tetraethylene pentamine 15 ethyloxylated | 1.3 | 1.3 | 1.3 | 1.3 | — |
| Ethylene diamine disuccinate | 1.3 | 1.3 | 1.3 | — | — |
| Minors (perfume/colorant/etc.) | 2.2 | 2.2 | 2.2 | 2.2 | 2.2 |
| Water | | | balance | | |
| pH | | | | | |

Cationic surfactant A is N,N-di(canolyl-oxy-2-oxo-ethyl)-N-methyl, N-(2-hydroxyethyl) ammonium chloride.

Cationic surfactant B is N-(canoyloxy-2-oxo-ethyl), N-methyl, N, N-di(2-hydroxyethyl) ammonium chloride.

In each of the examples the foaming detergent composition was packaged into a conventional aerosol can with a foam dispensing nozzle and valve together with carbon dioxide.

Secondly, the detergent compositions were packaged into conventional bottles for use directly in liquid form.

All of the compositions remained chemically stable after three months of storage. This is surprising because it was expected that diester quarternary ammonium compounds would be hydrolytically unstable at slightly alkaline pH.

What is claimed is:

1. A liquid detergent composition comprising enzymes, a boron derived enzyme stabilizing agent and a quaternary ammonium compound having a formula selected from the group consisting of:

[I]

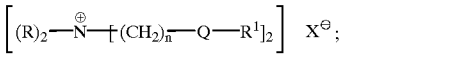

[II]

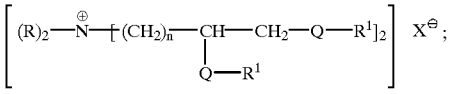

and mixtures thereof;

wherein Q is a functional unit having the formula selected from the group consisting of:

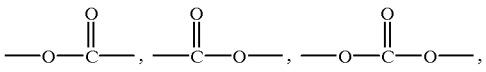

-continued

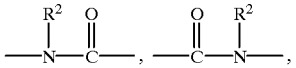

and mixtures thereof;

wherein each R unit is independently H, $C_1$–$C_6$ alkyl, $C_1$–$C_6$ hydroxyalkyl, and mixtures thereof; each $R^1$ unit is independently linear or branched $C_{11}$–$C_{22}$ alkyl, linear or branched $C_{11}$–$C_{22}$ alkenyl, and mixtures thereof; each $R^2$ is H, $C_1$–$C_4$ alkyl, $C_1$–$C_4$ hydroxyalkyl, and mixtures thereof; $X^-$ is an anion; and n is 1 to 4.

2. The liquid detergent composition according to claim 1 wherein the quatemary ammonium compound is a quaternary ammonium ester of the formula:

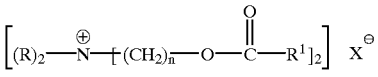

wherein R is methyl; and $R^1$, n and $X^-$ are as defined in claim 1.

3. The liquid detergent composition according to claim 2 wherein $R^1$ is independently linear or branched $C_{15}$–$C_{22}$ alkyl, linear or branched $C_{1\ 5}$–$C_{22}$ alkenyl, and mixtures thereof.

4. The liquid detergent composition according to claim 1 wherein the boron derived enzyme stabilizing agent is selected from the group consisting of borax, boric acid, the alkali metal or alkanolamine salts of tetraborate or metaborate and mixtures thereof.

5. The liquid detergent composition according to claim 1 wherein the composition has a pH which is between about 7 and about 10 when diluted to a 1% solution in distilled water.

6. The liquid detrgent composition according to claim 5 wherein composition has a pH which is between about 7.5 and about 8.5 when diluted to a 1% solution in distilled water.

7. The liquid detergent composition according to claim 1 wherein the composition comprises less than about 25% by weight of water.

8. The liquid detergent composition according to claim 7 wherein the composition comprises less than about 15% by weight of water.

9. A foam composition comprising enzymes, boron derived enzyme stabilizing agent and a quaternary ammoniurn compound having a formula selected from the group consisting of:

[I]

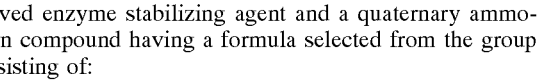

[II]

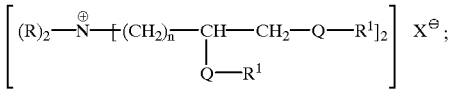

and mixtures thereof;

wherein Q is a functional unit having the formula selected from the group consisting of:

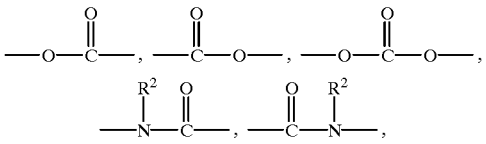

and mixtures thereof;

wherein each R unit is independently H, $C_1$–$C_6$ alkyl, $C_1$–$C_6$ hydroxyalkyl, and mixtures thereof; each $R^1$ unit is independently linear or branched $C_{11}$–$C_{22}$ alkyl, linear or branched $C_{11}$–$C_{22}$ alkenyl, and mixtures thereof; each $R^2$ is H, $C_1$–$C_4$ alkyl, $C_1$–$C_4$ hydroxyalkyl, and mixtures thereof; $X^-$ is an anion; and n is 1 to 4.

10. The foam composition according to claim 9 wherein the quaternary ammonium compound is a quaternary ammonium ester of the formula:

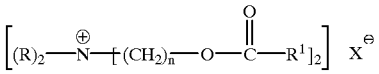

wherein R is methyl; and $R^1$, n and $X^-$ are as defined in claim 9.

11. The foam composition according to claim 9 wherein the boron derived enzyme stabilizing agent is selected from the group consisting of borax, boric acid, the alkali metal or alkanolamine salts of tetraborato or metaborate and mixtures thereof.

12. The foam composition according to claim 9 wherein the composition comprises less about 25% by weight of water.

13. The foam composition according to claim 12 wherein the composition comprises less than about 15% by weight of water.

14. A packaged product comprising:

a liquid detergent composition according to claim 1;

a propellant; and a container.

15. A packaged product according to claim 14 wherein the propellant is a non-liquifiable gas selected from carbon dioxide or nitrous oxide, or mixtures thereof.

* * * * *